United States Patent [19]

Oswald

[11] 4,075,975

[45] Feb. 28, 1978

[54] ROTATOR AND COATER SYSTEM FOR DRUM SHELLS

[75] Inventor: Donald E. Oswald, Foster City, Calif.

[73] Assignee: Kaiser Steel Corporation, Oakland, Calif.

[21] Appl. No.: 730,028

[22] Filed: Oct. 6, 1976

[51] Int. Cl.[2] ..... B05B 13/06

[52] U.S. Cl. ..... 118/318; 248/130

[58] Field of Search ..... 118/317, 318, 320, 321, 118/322, 306, 324, DIG. 10, 416, 254, 232; 214/1 Q; 51/13, 164; 15/304, 305; 248/128, 129, 130

[56] References Cited

U.S. PATENT DOCUMENTS

| | | | |
|---|---|---|---|
| 542,669 | 7/1895 | Winterbotham | 15/304 |
| 1,172,883 | 2/1916 | Gammeter | 248/130 |
| 1,231,092 | 6/1917 | Suhm | 214/1 Q |
| 1,796,691 | 3/1931 | Jansen | 118/320 X |
| 2,134,557 | 10/1938 | Hilbish et al. | 248/130 |
| 2,896,643 | 7/1959 | Ottoson | 15/304 |
| 3,252,442 | 5/1966 | Hazlett | 118/317 X |
| 3,389,009 | 6/1968 | McNulty et al. | 118/232 X |

*Primary Examiner*—Louis K. Rimrodt

[57] ABSTRACT

Drums are supported for rotation on idler rollers carried by an intermittently operable conveyor, and when the drums reach a predetermined position in which their longitudinal axes are aligned with telescopically movable coating material applicator heads the conveyor movement of the drums is stopped and an overhead assembly is moved downwardly into engagement with the drum shells to hold them down and rotate them while the coating applicator heads move inwardly and outwardly of the shells.

4 Claims, 3 Drawing Figures

ROTATOR AND COATER SYSTEM FOR DRUM SHELLS

SUMMARY OF THE INVENTION

The principal object of the invention is to provide a drum rotator system operable to power-rotate stationary, open-ended drum shells while maintaining their horizontally positioned longitudinal axes fixedly positioned in space.

Other objects and advantages of the invention will be apparent from the following descriptive taken in conjunction with the drawing forming part of this specification, and in which.

DESCRIPTION OF THE INVENTION

Figure 1:
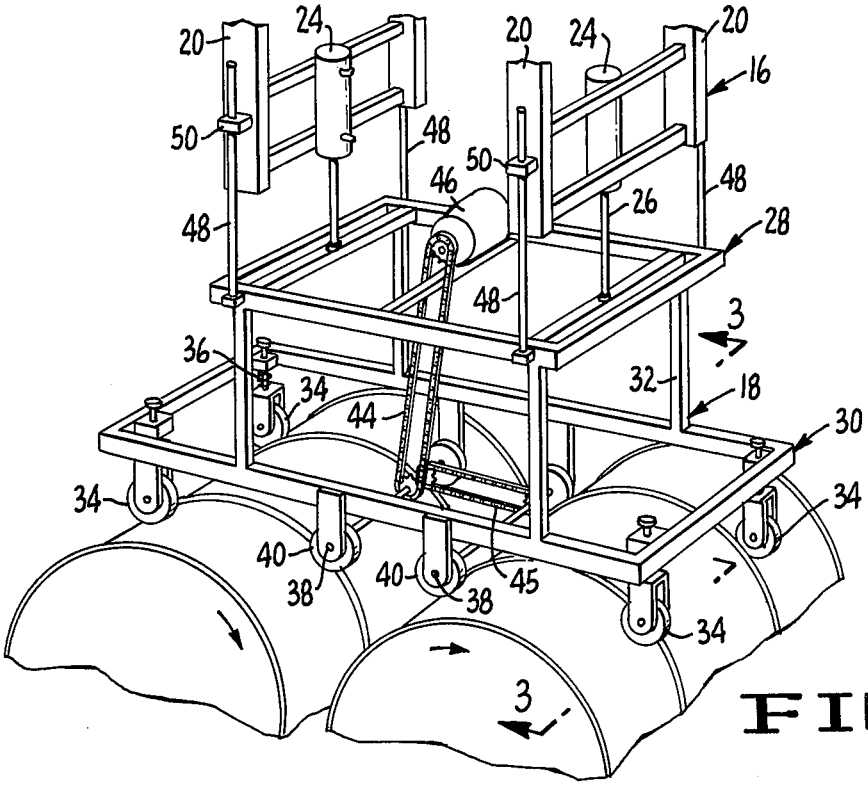
FIG. 1 is a view in perspective of the drum rotator of the invention.

The present drum shell, or drum, rotator comprises a conveyor 10, drum support means carried by the conveyor comprising cradle members 12 having idler rolls 14, an overhead, fixed support frame indicated generally by 16, and an overhead movable support frame indicated generally by 18.

The fixed frame 16 comprises vertical frame member 20 and horizontal frame members 22, the latter supporting a pair of air cylinders 24. The cylinders 24 are provided with cylinder rods 26 which support the movable frame 18.

The movable frame 18 comprises an upper, rectangular framework 28, a lower rectangular framework 30, and vertical hanger members 32 interconnecting the frameworks 28 and 30. Supported from the framework 30 are four idler rollers 34 having associated therewith springs 36. Also supported from framework 30 is a pair of rotatable shafts 38 having fixedly attached thereto drive rollers 40. The shafts 38 are provided with gear wheels 42 which are driven by belts 44, 45 which in turn are driven by motor 46 mounted on upper framework 28. The movable frame 18 is provided with vertically extending guide rods 48 which travel within fixed sleeve guide members 50 carried by the upper, fixed frame 16.

Figure 2:
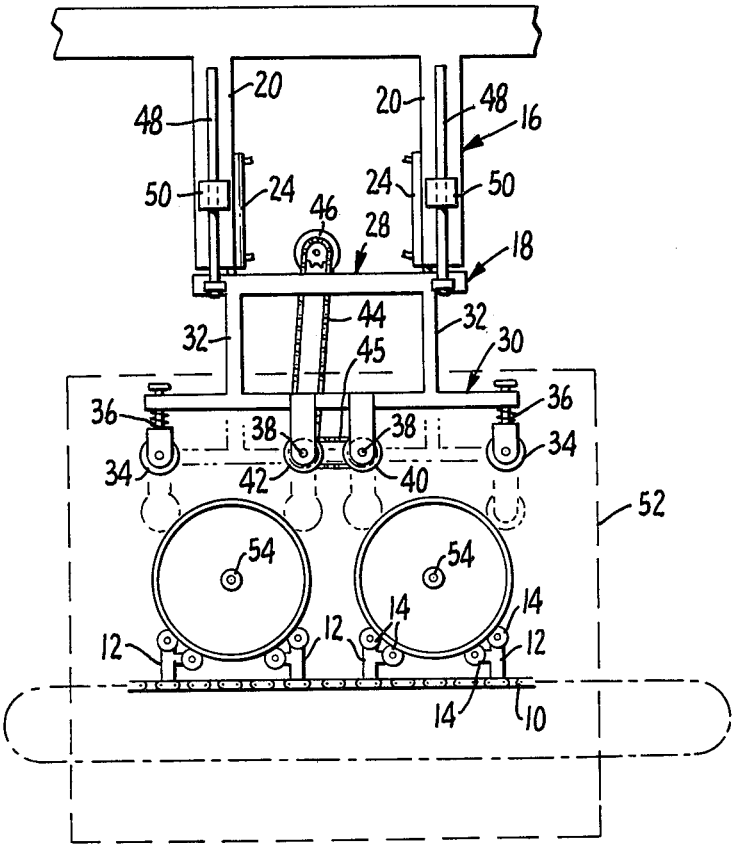
FIG. 2 is a view in front elevation of the overall drum rotator.
Figure 3:
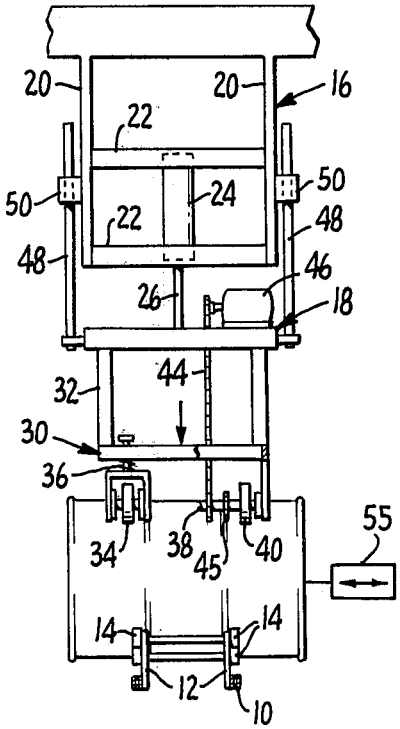
FIG. 3 is a view taken along lines 3—3 of FIG. 1.

The rectangular, dotted outline 52 in FIG. 2 indicates the coating application booth within which the drum shells are internally coated.

The operation of the drum shell rotator and coater system is as follows. Drum shells are placed between the cradle members 12 of the conveyoer 10. Motor 46 and drive rollers 40 run continuously. When the shells reach the FIG. 2 position, conveyor 10 is stopped by any suitable control device. This initiates downward movement of the frame 18 to bring the rollers 34 and 40 into pressing engagement with the drum shells to rotate the drum shells. As this occurs, operation of the coating applicator heads 54, i.e. spray applicator means, which are normally disposed outside of the drums in alignment with the central axes thereof, commences. The heads are provided with means 55 to move them axially into the shells for substantially the full length thereof and then axially out of the shells. During this movement the coating material, e.g. a paint or a resin powder, is dispended radially from the leading end of the head to coat the interior of the shell. The heads 54 then are retracted from the shells. When they are fully withdrawn from the shells, frame 18 is moved to a raised position by cylinders 24, and the conveyor 10 then moves to convey the coated shells away for subsequent handling and to convey a pair of uncoated shells to the FIG. 2 position for coating.

The rate of rotation of the drum shells is approximately 100 rpm. At such a speed there is a great tendency for the shells to bounce up and down to some degree. It is important, on the other hand, that such bouncing be prevented in order that the applicator heads 54 may at all times during coating application be in alignment with the longitudinal axes of the drum shells. This is accomplished by the overhead drum shell rotator and drum shell hold-down system whereby under the hold-down action of the air cylinders and the springs 36 all of the idler rollers 34 and the driver rollers 40 are maintained, against upward movement thereof, in a joint hold-down operation with respect to the shells.

What is claimed is:

1. Drum handling apparatus comprising roller support means for supporting a horizontally disposed drum for rotation, and drum rotator and hold-down means operable to rapidly rotate a drum on said support means while suppressing horizontal and vertical movement of said drum, said rotator and hold-down means comprising an overhead frame, means supporting said frame for guided, reciprocatable, vertical movement, power rollers and idler rollers carried by said frame, depending therefrom, and adapted to engage and rotate said drum when said frame is moved downwardly, power means to move said frame downwardly and press said power and idler rollers against said drum and to thereafter move said frame upwardly, and a motor mounted on said frame, movable therewith, and driveably connected to said power rollers.

2. The apparatus of claim 1, further comprising horizontally disposed spray applicator means in axial alignment with said drum, and means to move said applicator means axially into and axially out of said drum while said drum is being held down and rapidly rotated.

3. The apparatus of claim 1, said roller support means being adapted to support a pair of drums in side by side relation, said power and idler rollers being adapted to jointly and severally engage said drums, the power rollers being engageable with adjacent sides of said drums and the idler rollers being engageable with the outer sides of said drums and said motor being connected to the power rollers to drive said drums.

4. The apparatus of claim 3, further comprising horizontally disposed spray applicator means in axial alignment with said drums, and means to move said applicator means axially into and axially out of said drums while said drums are being held down and rapidly rotated.

* * * * *